US007407013B2

(12) United States Patent
Whitsitt

(10) Patent No.: US 7,407,013 B2
(45) Date of Patent: Aug. 5, 2008

(54) EXPANDABLE WELL SCREEN WITH A STABLE BASE

(75) Inventor: John Whitsitt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 61 days.

(21) Appl. No.: 11/614,322

(22) Filed: Dec. 21, 2006

(65) Prior Publication Data

US 2008/0149347 A1 Jun. 26, 2008

(51) Int. Cl.
*E21B 43/08* (2006.01)
*E21B 43/10* (2006.01)

(52) U.S. Cl. ..... 166/381; 166/227; 166/207; 166/382

(58) Field of Classification Search ..... 166/227, 166/381, 382, 207
See application file for complete search history.

(56) References Cited

U.S. PATENT DOCUMENTS 6,454,013 B1 9/2002 Metcalfe
6,648,071 B2 11/2003 Hackworth et al.
6,675,901 B2 1/2004 Johnson et al.
6,679,334 B2 1/2004 Johnson et al.
6,688,397 B2 2/2004 McClurkin et al.
6,695,054 B2 2/2004 Johnson et al.
6,695,067 B2 2/2004 Johnson et al.
6,719,064 B2 4/2004 Price-Smith et al.
6,722,437 B2 4/2004 Vercaemer et al.
6,742,598 B2 * 6/2004 Whitelaw et al. ..... 166/387
6,772,836 B2 8/2004 Schetky et al.
6,789,621 B2 9/2004 Wetzel et al.
6,799,637 B2 10/2004 Schetky et al.
6,817,410 B2 11/2004 Wetzel et al.
6,820,690 B2 11/2004 Vercaemer et al.
7,036,600 B2 5/2006 Johnson et al.
7,048,052 B2 5/2006 Hackworth et al.
7,055,609 B2 6/2006 Hayes et al.
7,077,196 B2 * 7/2006 Rudd ..... 166/207
7,086,476 B2 8/2006 Johnson et al.
7,108,083 B2 * 9/2006 Simonds et al. ..... 175/57
7,204,316 B2 * 4/2007 Dusterhoft et al. ..... 166/381
2002/0092649 A1 * 7/2002 Bixenman et al. ..... 166/278
2002/0107562 A1 8/2002 Hart et al.
2003/0056948 A1 * 3/2003 Cameron ..... 166/206
2003/0079885 A1 5/2003 Schetky et al.
2003/0221829 A1 12/2003 Patel et al.
2004/0084176 A1 5/2004 Hackworth et al.
2004/0104026 A1 6/2004 Johnson et al.
2004/0177959 A1 9/2004 Schetky et al.
2004/0251033 A1 * 12/2004 Cameron et al. ..... 166/382
2005/0039927 A1 2/2005 Wetzel et al.
2005/0139394 A1 * 6/2005 Maurer et al. ..... 175/65

(Continued)

FOREIGN PATENT DOCUMENTS

GB 2367842 A 4/2002

*Primary Examiner*—Hoang Dang
(74) *Attorney, Agent, or Firm*—Jeremy P. Welch; Bryan P. Galloway; Tim Curington

(57) ABSTRACT

An expandable well screen system includes a screen assembly having a base pipe, a strut, and a screen expandable from a retracted position to an expanded position in the wellbore; and an insert guide disposed in the base pipe when the screen is in the expanded position, wherein the base pipe maintains substantially the same geometric dimensions when the screen is in the retracted position and the expanded position.

20 Claims, 3 Drawing Sheets

U.S. PATENT DOCUMENTS

2005/0241709 A1 11/2005 Johnson et al.
2006/0027376 A1 2/2006 Schetky et al.
2006/0037745 A1 2/2006 Hart et al.

* cited by examiner

EXPANDABLE WELL SCREEN WITH A STABLE BASE

FIELD OF THE INVENTION

The present invention relates in general to wellbore completion assemblies and more specifically to an expandable well screen with a stable base that provides increased collapse support.

BACKGROUND

Often wellbores, whether completed open-hole or with perforated casing, produce excess sand. In order to control the flow of particles into the wellbore, well screens are commonly positioned adjacent to the perforated or unlined portion of the wellbore. Typical sand control systems include stand-alone screens (SAS), open-hole gravel packs (OHGP), and expandable sand screens (ESS).

SAS systems include a relatively large annulus formed between the wall of the wellbore and the screen. The systems commonly experience localized screen plugging resulting in increased flow velocity through the screen causing erosion and ultimate failure of the system.

OHGP systems are similar to SAS systems with the inclusion of a proppant placed in the annulus between the screen and the wellbore wall forming a "gravel pack." Common drawbacks of these systems are the cost and complexity of providing the gravel pack and bridging that results in poor gravel packs.

In conventional ESS systems the entire sand screen assembly is expanded to the wall of the wellbore, minimizing the annulus between the outside diameter of the screen and the inside diameter of the wellbore. These systems address the cost and complexity of placing a gravel pack, however, they introduce cost and complexity of expanding the screen assembly. A significant drawback of conventional ESS systems is that the internal base pipe that underlies the screen assembly is expanded resulting in a reduced collapse strength that renders the systems as unsuitable for wells with large overburdens.

Therefore, it is a desire to provide an expandable well screen that addresses drawbacks of the current and prior sand control completion systems. It is a further desire to provide an expandable well screen that minimizes the annulus between the screen and the wellbore wall. It is still a further desire to provide an expandable well screen that includes an expandable screen with a stable base pipe that maintains a substantially constant geometry before and after expansion of the screen.

SUMMARY OF THE INVENTION

In view of the foregoing and other considerations, the present invention relates to an expandable well screen assembly for use in a subterranean wellbore wherein the base pipe maintains its structural integrity when the screen is expanded.

An embodiment of an expandable well screen system includes a screen assembly having a base pipe, a strut, and a screen expandable from a retracted position to an expanded position in the wellbore; and an insert guide disposed in the base pipe when the screen is in the expanded position, wherein the base pipe maintains substantially the same geometric dimensions when the screen is in the retracted position and the expanded position.

An embodiment of an expandable screen assembly includes a screen expandable from a retract position to an expanded position and at least two struts, wherein each of the struts has a pad positioned between the base pipe and the screen, wherein the struts urge the screen outward from the base pipe into the expanded position.

An embodiment of a method of expanding a well screen in a wellbore includes the steps of providing a screen assembly having a base pipe, struts, and a screen connected circumferentially about the struts and base pipe; positioning the screen assembly in the wellbore with the screen in a retracted position; and actuating the struts expanding the screen outwardly from the base pipe into an expanded position.

The foregoing has outlined the features and technical advantages of the present invention in order that the detailed description of the invention that follows may be better understood Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
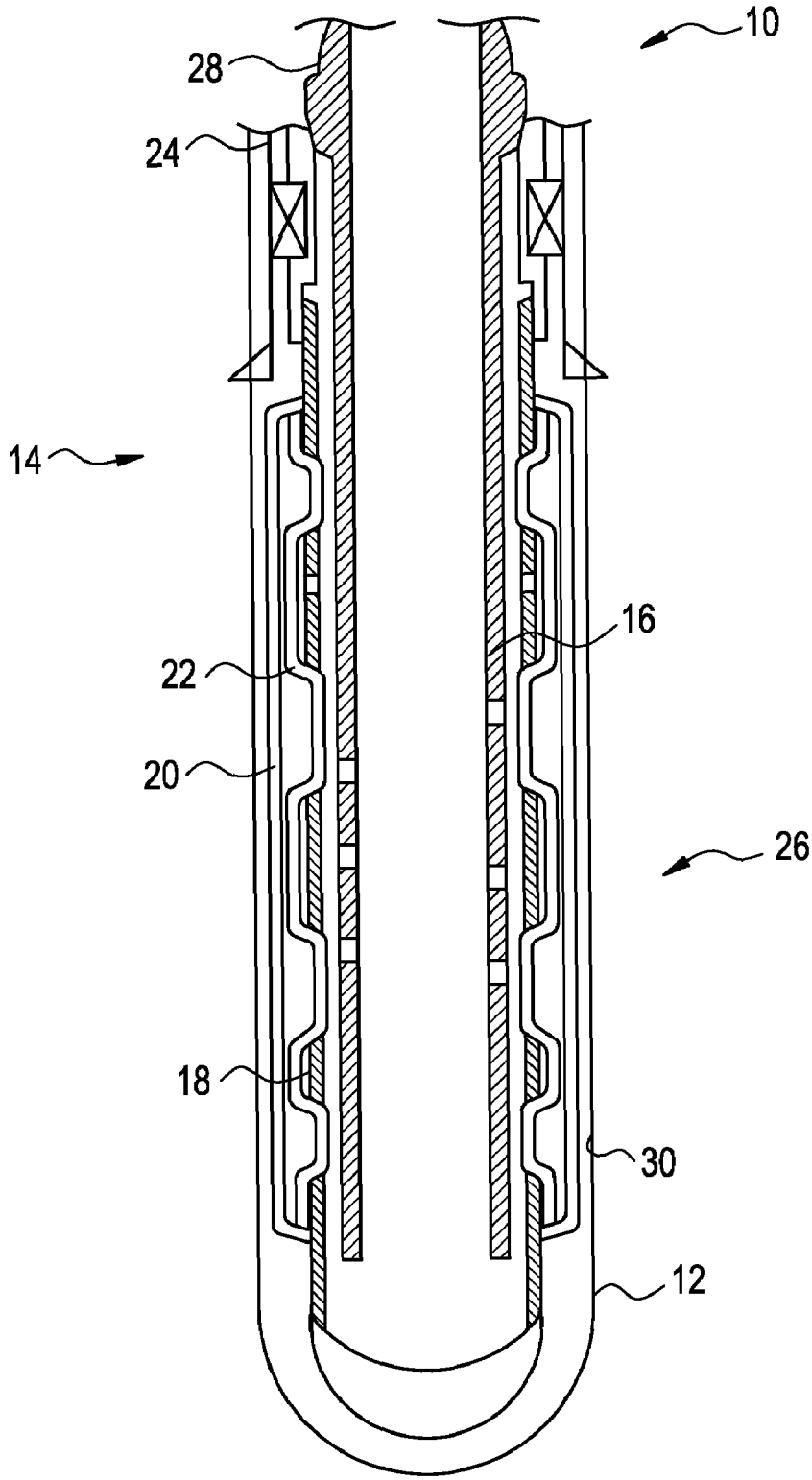
FIG. 1 is a schematic of an embodiment of an expandable well screen system of the present invention disposed in a wellbore.

Refer now to the drawings wherein depicted elements are not necessarily shown to scale and wherein like or similar elements are designated by the same reference numeral through the several views.

As used herein, the terms "up" and "down"; "upper" and "lower", and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic of an embodiment of an expandable well screen system of the present invention, generally designated by the numeral 10, disposed within a wellbore 12. Expandable well screen system 10 includes a screen assembly 14 and an insertion guide 16. Screen assembly 14 includes a base pipe 18, expandable screen or filter layer 20 and struts 22.

In the embodiment illustrated in FIG. 1, a portion of wellbore 12 is completed with casing 24 positioned above an open hole section 26. Although well screen assembly 10 is positioned within open hole section 26 it should be recognized that well screen assembly 10 may be positioned and installed within a portion of wellbore 12 having perforated casing 24.

Well screen assembly 10 is conveyed into wellbore 12 and positioned at depth via a conveyance 28 such as drill pipe. Insertion guide 16 may be run into wellbore 12 in the same trip with screen assembly 14 or in a subsequent trip. Insertion guide 16 is positioned within screen assembly 14 expanding screen 10 outwardly and into contact with a wall 30 of wellbore 12 or a surrounding casing. Insertion guide 16 may also provide additional structural strength and support to base 18. Screen 14 is expanded to the engaged position without changing the geometry of base 18 and thus without reducing the collapse strength of base 18 or materially affecting the collapse strength of screen assembly 14.

Figure 2A:
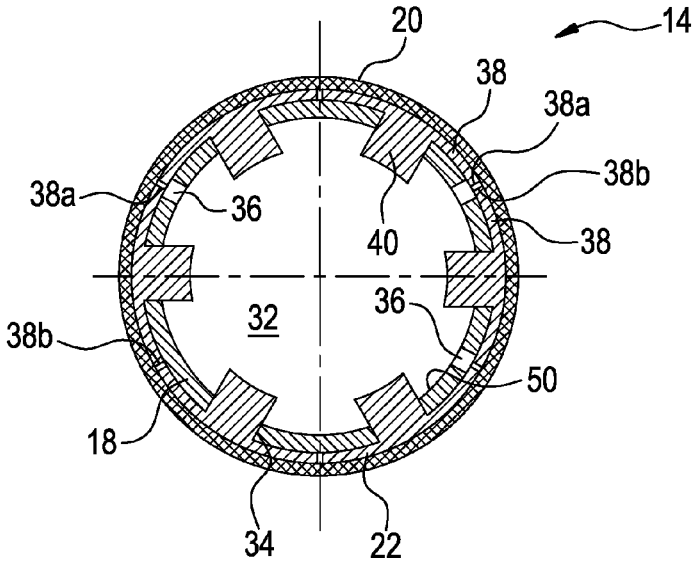
FIG. 2A is a top view of an embodiment of a expandable screen assembly of the present view in the retracted position.
Figure 2B:
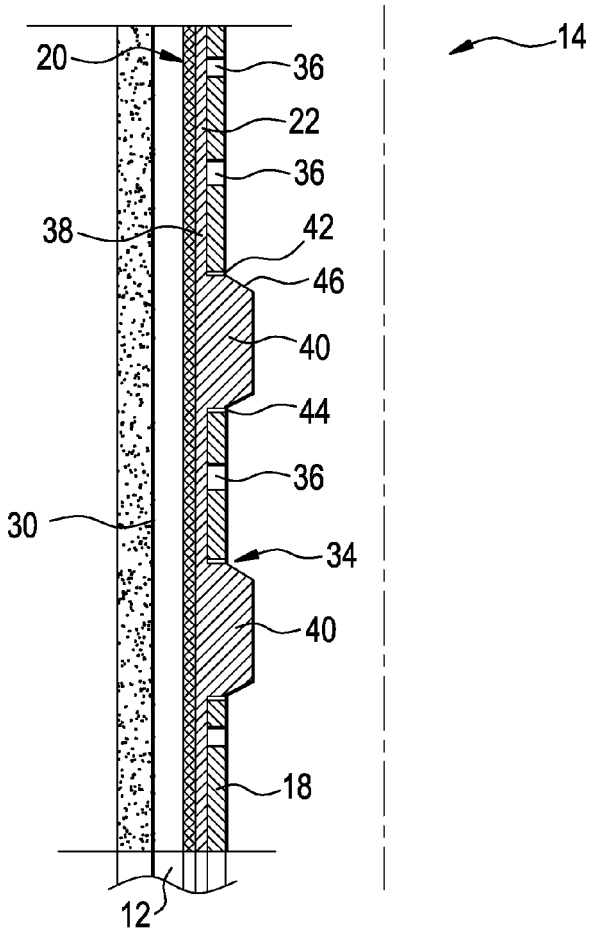
FIG. 2B is a partial, cross-sectional side view of the screen assembly of FIG. 2A in a wellbore.

Refer now to FIGS. 2A and 2B wherein screen assembly 14 is shown in the retracted position for running into the wellbore. FIG. 2A is a top view of an embodiment of screen assembly 14. FIG. 2B is an illustration of screen assembly 14 positioned within wellbore 12.

Base 18 is a tubular member such as pipe having a bore 32. Base pipe 18 is selected from materials having sufficient collapse strength for the particular wellbore application and of a sufficient length for the wellbore section to be screened. It should be readily recognized that base pipe 18 may include a plurality of interconnected joints. Base pipe 18 additionally includes spaced keyways 34 and perforations 36.

A plurality of struts 22 are positioned in functional connection with base pipe 18 for expanding screen 14 outwardly from base pipe 18. Each strut 22 includes a pad 38 and one or more heads 40. Pad 38 of each strut 22 is positioned exterior of base pipe 18 with each head 40 protruding through a keyway 34 into bore 32, when assembly 14 is in the retracted position.

Screen 20 is connected circumferentially about strut pads 38 and base pipe 18. Screen 20 is formed of a mesh material for passing the desired fluids while blocking the flow of undesired particles. Screen 20 may be a plastically expandable material such as sintered woven metal. Screen 20 may include pleats to facilitate expansion to the wellbore wall (FIGS. 1 and 3B).

Each pad 38 has a lateral width between ends 38*a* and 38*b* (FIG. 2A) and a longitudinal length (FIG. 2B) that may extend substantially the length of assembly 14. Pads 38 are arcuate members along their lateral width substantially matching the curvature of the radius of base pipe 18. Desirably, a plurality of struts 22 are connected within assembly 14 such that end 38*a* substantially abuts end 38*b* of the adjacent pad 38 when screen assembly 14 is in the retracted position.

A sealing mechanism 42 may be provided between head 40 and base pipe 18 at keyway 34 in a manner such that when assembly 14 is in the retracted position keyway 34 is substantially sealed to fluid flow. This sealing engagement provides fluid loss control when running assembly 14 into wellbore 12. In the illustrated embodiment, sealing mechanism 42 includes tapering the outer surface of head 40 from a first diameter section 44 proximate pad 38 to form a smaller diameter section 46 such that in the retracted position first diameter section 44 substantially fills keyway 34 and when assembly 14 is in the expanded position keyway 34 is open (FIGS. 1, 3A and 3B).

Figure 3A:
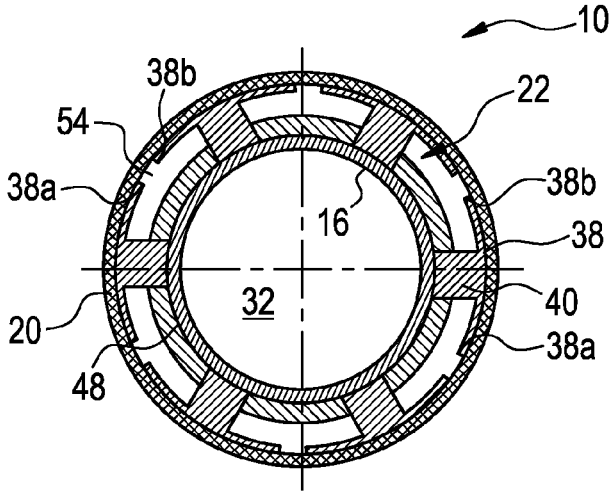
FIG. 3A is a top view of an embodiment of a expandable well screen system of the present invention with the screen in the expanded position.
Figure 3B:
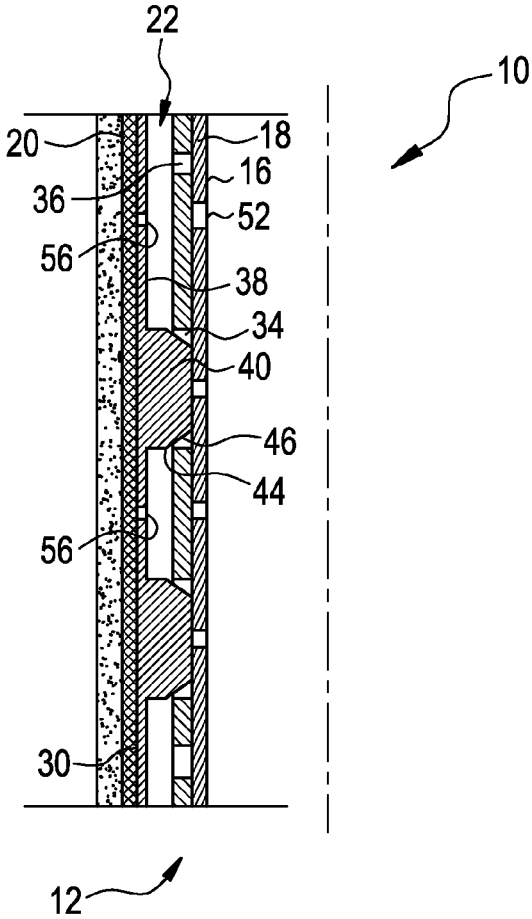
FIG. 3B is a partial, cross-sectional side view of the expandable well screen system of FIG. 3A in a wellbore.

Refer now to FIGS. 3A and 3B wherein expandable well screen system 10 is illustrated in the expanded or working position. FIG. 3A is a top view of well screen system 10 and FIG. 3B is a side view of system 10 expanded in wellbore 12.

Insertion guide 16 is inserted within base pipe 18 thus contacting heads 40 of struts 22 urging pads 38 toward wellbore wall 30. The outside diameter 48 of insertion guide 16 is substantially the same as the inside diameter 50 (FIG. 2A) of base pipe 18 such that insertion guide 16 is substantially flush with base pipe 18. Insertion guide 16 further includes holes or perforations 52 to facilitate fluid drainage. Insertion guide 16 and struts 22 provide a mechanism for expanding filter layer 20 outward to wall 30 without the deformation, and thus loss of collapse strength, of base pipe 18. Insertion guide 16 may provide additional strength and support to base pipe 18 and system 10.

The combination of the lateral width and longitudinal length of pad 38 facilitates expanding screen 20 in a manner that limits deflection points in screen 20 thereby minimizing the annulus between wall 30 and screen 20. When struts 22 are extended, reduced diameter section 46 of head 40 is positioned within keyway 34 permitting fluid flow through keyway 34. In the extended position, openings 54 are formed and/or expanded between the lateral ends 38*a*, 38*b* of adjacent pads 38. Pads 38 may include additional perforations 56 to facilitate fluid drainage.

An embodiment of a method of using and expanding expandable well screen system 10 of the present invention is now described with reference to the various Figures. Wellbore 12 is drilled and a portion of wellbore 12 is selected for completion with a screen assembly. The portion of the well to be completed may be cased or open-hole and includes a wall 30. Screen assembly 14 having base pipe 18, struts 22 and screen layer 20 are run into wellbore 12 to the desired depth on conveyance 28. Insertion guide 16 may be conveyed in the same trip as screen assembly 14 or in a subsequent trip after placement of screen assembly 14.

Screen assembly 14 is run into wellbore 12 in the retracted position wherein pads 38 of struts 22 are substantially flush with the outer surface of base pipe 18 and filter layer 20 is constricted about pads 38 and base pipe 18. Keyways 34 may be substantially sealed about heads 40 to fluid flow. Desirably the perforations formed through base pipe 18 are offset from any perforations or openings formed through or between pads 38 such that fluid loss is limited when running screen assembly 14 into wellbore 12.

To expand screen layer 20 toward wall 30, insertion guide 16 is run into bore 32 of base pipe 18. Insertion guide 16 may be inserted into base pipe 18 by putting weight on conveyance 28 or other means known in the art. As insertion guide 16 is disposed in base pipe 18 it contacts heads 40 of strut 22 forcing pads 38 outward. Pads 38 expand screen layer 20 toward wall 30 and desirably into contact with wall 30. The width and length of pads 38 facilitate expanding screen layer 20 limiting points of deflection in screen 20 and thus minimizing the annulus between wall 30 and screen 20. Expanding screen 20 via struts 22 and insertion guide 16 maintains the geometry and structural integrity of base pipe 18.

In the expanded position, screen system 10 permits fluid flow between the surrounding formation, i.e. wall 30, and the interior of screen assembly 14, i.e. bore 32. Pads 38 may include perforations 56 and openings are formed between the lateral ends of adjacent pads 38. When struts 22 are extended, keyways 34 are unsealed for fluid flow. Base pipe 18 may include additional perforations 36. Insertion guide 16 also includes perforations 52. The placement of insertion guide 16 flush with the inside diameter of base pipe 18 provides further structural strength to base pipe 18 and screen assembly 14.

From the foregoing detailed description of specific embodiments of the invention, it should be apparent that an expandable well screen system with a constant geometry base that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. An expandable well screen system for use in a subterranean wellbore, the system comprising:

a screen assembly having a base pipe, a strut, and a screen expandable from a retracted position to an expanded position in the wellbore, and an insert guide disposed in the base pipe when the screen is in the expanded position, wherein the base pipe maintains substantially the same geometric dimensions when the screen is in the retracted position and the expanded position.

2. The system of claim 1, wherein the strut includes:

a pad positioned between the screen and the based pipe; and a head extending into the base pipe when the screen is in the retracted position.

3. The system of claim 1, wherein the strut includes and arcuate pad positioned between the screen and the base pipe.

4. The system of claim 1, wherein the screen assembly includes a least two struts, each strut having a pad positioned between the screen and the base pipe.

5. The system of claim 1, wherein the strut includes:

an arcuate pad positioned between the screen and the base pipe; and a head extending from the pad into the base pipe through a keyway when the screen is in the retracted position.

6. The system of claim 5, wherein the keyway is substantially sealed to fluid flow when the screen is in the retracted position.

7. The system of claim 1, wherein the screen assembly includes more than one strut, each strut having a pad positioned between the screen and the base pipe, and each of the pads having opposing lateral ends, wherein when the screen is in the retracted position the lateral ends of each pad substantially abut the lateral ends of the adjacent pad.

8. The system of claim 7, wherein each pad includes a head that extends into the base pipe through a keyway when the screen is in the retracted position.

9. The system of claim 8, wherein each pad is arcuate across its lateral width substantially matching the radius of curvature of the base pipe.

10. The system of claim 8, wherein each keyway is substantially sealed to fluid flow when the screen is in the retracted position.

11. The system of claim 9, wherein each keyway is substantially sealed to fluid flow when the screen is in the retracted position.

12. The system of claim 6, wherein the head has a first diameter section proximate the pad and a second diameter section having a diameter less than the first diameter section.

13. The system of claim 10, wherein each of the heads has a first diameter section proximate the pad and a second diameter section having a diameter less than the first diameter section.

14. A screen assembly for use in a subterranean wellbore, the assembly comprising:

a base pipe;

a screen expandable from a retract position to an expanded position; and at least two struts, each strut having a pad positioned between the base pipe and the screen, wherein the struts urge the screen outward from the base pipe into the expanded position.

15. The screen assembly of claim 14, wherein when the screen is in the retracted position the pads substantially abut one another about the circumference of the base pipe.

16. The screen assembly of claim 15, wherein each pad includes at least one head extending into the base pipe when the screen is in the retracted position.

17. A method of expanding a well screen in a wellbore, the method comprising the steps of:

providing a screen assembly having a base pipe, struts, and a screen connected circumferentially about the struts and base pipe;

positioning the screen assembly in the wellbore with the screen in a retracted position; and actuating the struts expanding the screen outwardly from the base pipe into an expanded position.

18. The method of claim 17, wherein the step of actuating includes dispensing an insert within the base pipe to act on the struts.

19. The method of claim 17, wherein each strut includes a pad positioned between the screen and the base pipe and the pads and the pads substantially abut one another about the circumference of the base pipe when the screen is in the retracted position.

20. The method of claim 17, wherein the base pipe maintains the same geometric dimensions when the screen is in the expanded position as when the screen is in the retracted position.

* * * * *